US006253390B1

(12) United States Patent
Laks

(10) Patent No.: US 6,253,390 B1
(45) Date of Patent: Jul. 3, 2001

(54) AQUATIC RAISABLE FLOOR APPARATUS

(75) Inventor: Edward E. Laks, Burnaby (CA)

(73) Assignee: Precision Fibre Structures Inc., Surrey (CA)

( * ) Notice: Subject to any disclaimer, the term of this patent is extended or adjusted under 35 U.S.C. 154(b) by 0 days.

(21) Appl. No.: 09/546,678

(22) Filed: Apr. 11, 2000

(51) Int. Cl.[7] ..... E04H 4/00
(52) U.S. Cl. ..... 4/495; 4/488
(58) Field of Search ..... 401/495, 499, 401/501, 488; 187/206, 208, 270, 213

(56) References Cited

U.S. PATENT DOCUMENTS

| | | | | |
|---|---|---|---|---|
| 3,423,768 | * | 1/1969 | Glenn | 4/501 |
| 3,670,343 | * | 6/1972 | Gansloser | 4/495 |
| 3,734,113 | * | 5/1973 | Madden | 137/40 |
| 3,760,432 | * | 9/1973 | Glorisi | 4/495 |
| 3,934,680 | * | 1/1976 | Bishop | 187/206 |
| 4,364,131 | * | 12/1982 | Clerk | 4/495 |
| 4,716,603 | * | 1/1988 | Sernetz | 4/501 |
| 5,025,512 | * | 6/1991 | Niimura | 4/495 |

FOREIGN PATENT DOCUMENTS

| | | | | |
|---|---|---|---|---|
| 2234088 | * | 1/1974 | (DE) | 4/495 |

* cited by examiner

*Primary Examiner*—Gregory L. Huson
*Assistant Examiner*—Huyen Le
(74) *Attorney, Agent, or Firm*—Norman M. Cameron

(57) ABSTRACT

AN AQUATIC raisable floor apparatus includes a platform and a buoyancy chamber in the platform with a top and a bottom. The chamber is closed on the top and open to the pool near the bottom. There is an air supply connected to the chamber. A valve is capable of venting the chamber to atmosphere. The platform is raised by filling the chamber with air from the air supply and the platform is lowered by venting air from the chamber to atmosphere through the vent. There is also a guide mechanism for guiding the platform as the platform is raised or lowered. The guide mechanism includes vertically extending racks. Rotatable pinions engage the racks.

14 Claims, 10 Drawing Sheets

AQUATIC RAISABLE FLOOR APPARATUS

BACKGROUND OF THE INVENTION

This invention relates to raisable floor apparatuses for pools and, in particular, to floors which can be raised by pumping air into the apparatuses and which include guide mechanisms for guiding the floors as they are raised and lowered.

Swimming pools, for example large public pools, have different depth requirements for different uses. For example, the pool, or at least portion of the pool, should be relatively shallow when used by young children. However, the pool should be deeper when configured for older children or adults, particularly when the users may dive into the pool. To obviate the need for a plurality of pools for different uses, it is known to provide a raisable floor whereby the pool can have an adjustable depth, at least for a portion of the length thereof. Some raisable floors are relatively heavy, being made of concrete for example, and require complex and expensive hydraulic equipment to raise or lower them. Such units have not been sufficiently economical for many potential users.

Attempts have been made to develop alternative mechanisms for raising and lowering the floors. An example is found in U.S. Pat. No. 4229843 to Belanger. This patent discloses pipes which can be filled with water or air to lower or raise the floor. Adjustable legs hold the floor at a desired position. There is a pump to supply the pipes with water in order to lower the floor.

There still remains a need, however, for a relatively economical and simple raisable floor apparatus which can offer reliable, safe operation for a sustained period of time.

Accordingly, it is an object of the invention to provide an improved raisable floor apparatus for swimming pools which is simple and relatively economical to produce and sell.

It is another object of the invention to provide an improved raisable floor apparatus for pools which is rugged and durable.

It is further object of the invention to provide improved raisable floor apparatus for pools which is easy to operate.

SUMMARY OF THE INVENTION

There is provided, according to one aspect of the invention, a raisable floor apparatus for a pool. This comprises a platform and a chamber in the platform with a top and a bottom. The chamber is closed on the top and open to the pool near the bottom. There is an air supply means. A conduit connects the air supply means to the chamber. There is means for venting the chamber to atmosphere. The platform is raised by filling the chamber with air from the air supply means when the pool is at least partially filled with water and the platform is lowered by venting air from the chamber to atmosphere through the means for venting.

There is provided, according to another aspect ofthe invention, a raisable floor apparatus for a pool which includes a platform. There is means for raising and lowering the platform to make at least a portion of the pool shallower or deeper. There is a guide mechanism for guiding the platform as the platform is raised or lowered. The guide mechanism includes vertically extending racks. There are pinions which engage the racks.

BRIEF DESCRIPTION OF THE DRAWINGS

Referring to the drawings.

DETAILED DESCRIPTION OF THE PREFERRED EMBODIMENTS

Figure 1:
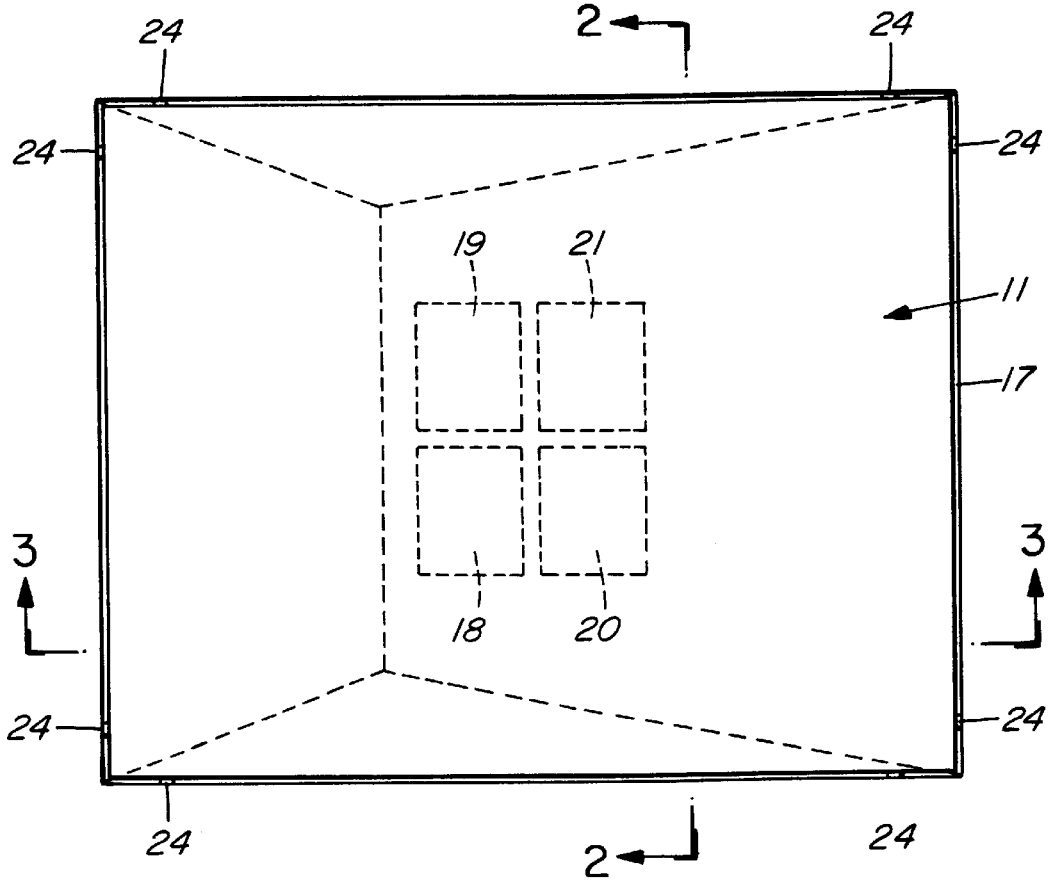
FIG. 1 is a top plan view of a raisable floor apparatus, according to a first embodiment of the invention, shown within a pool.
Figure 2:
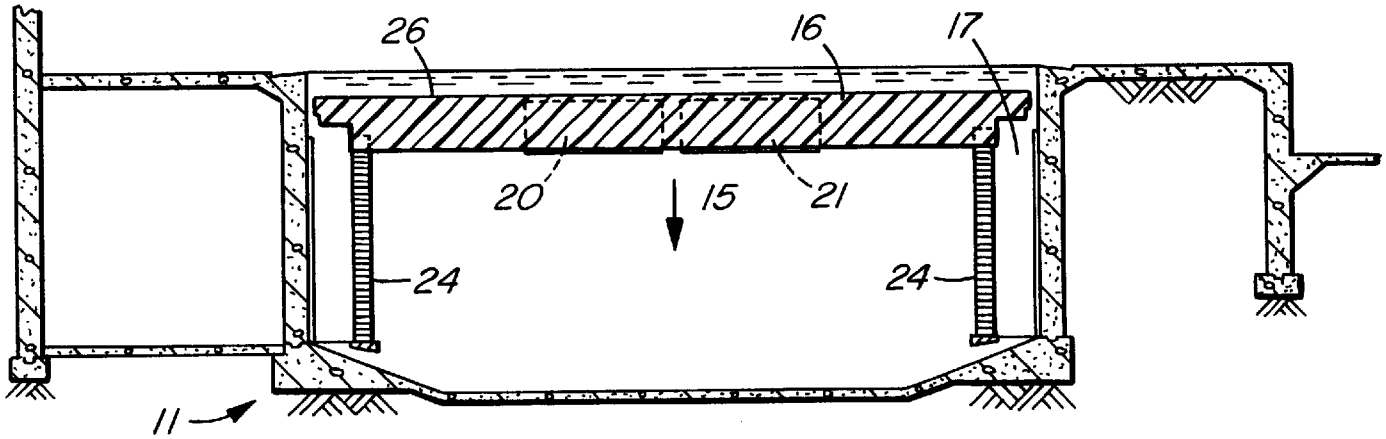
FIG. 2 is a sectional view taken along line 2—2 of FIG. 1 with the apparatus in the raised position.
Figure 3:
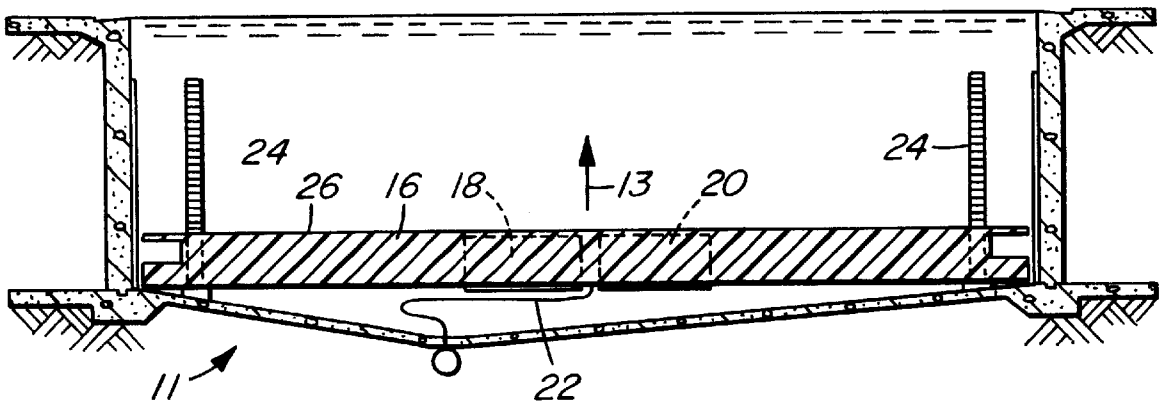
FIG. 3 is a sectional view taken along line 3—3 of FIG. 1, with the apparatus in the lowered position.
Figure 4:
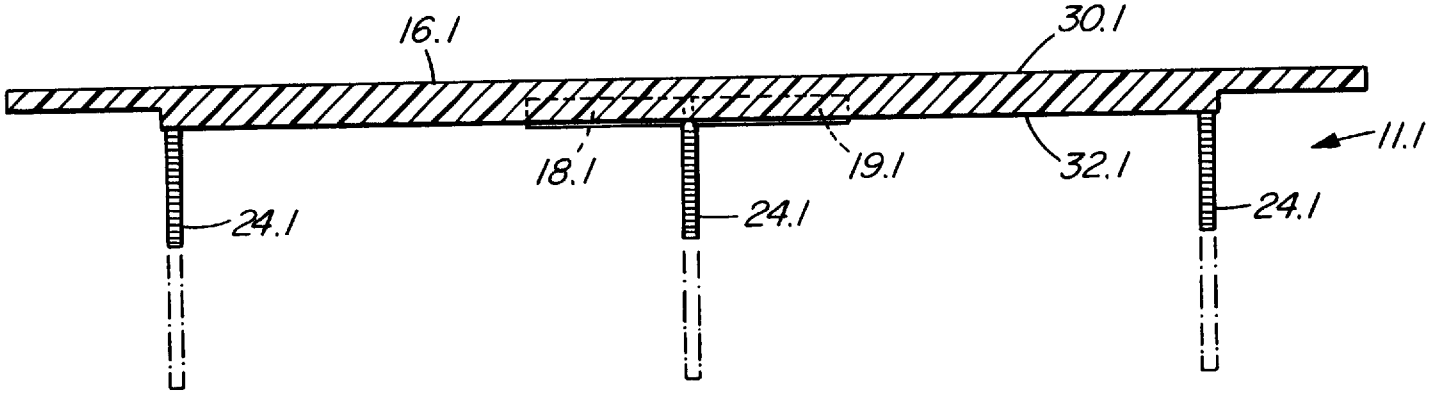
FIG. 4 is a view similar to FIG. 3 of an alternative embodiment of the invention excluding the pool.

Referring to the drawings and first to FIGS. 1–3, these show a raisable floor apparatus 11 which is adapted to be raised or lowered, as indicated by arrows 13 and 15, in a pool 17. Unlike some prior art devices, the invention employs an open system for raising or lowering platform 16. The platform is equipped with four buoyancy chambers, chambers 18, 19, 20 and 21. There is an air compressor C, shown in FIG. 7, which supplies air to the buoyancy chambers through conduit 22. There is also means for venting chambers 18, 19, 20 and 21 to atmosphere, provided by exhaust valves v, in control panel 23 shown in FIGS. 7 and 15. When it is desired to raise platform 16, as illustrated, compressor C is used to pump air into the chambers 18, 19, 20 and 21. The weight and size of the platform 16 are such that, when the chambers 18, 19, 20 and 21 are filled with air, the platform rises towards the surface when the pool is filled with water.

When it is desired to have the platform move towards the bottom of the pool, the valves are opened, allowing air from the chambers to vent to atmosphere. This causes water from the pool to move upwardly and occupy chambers 18, 19, 20 and 21. In this sense the system is an open one, because a water pump is not needed to flood the chambers. Instead the apparatus simply uses the pool water itself to change the buoyancy of the platform.

Figure 15:
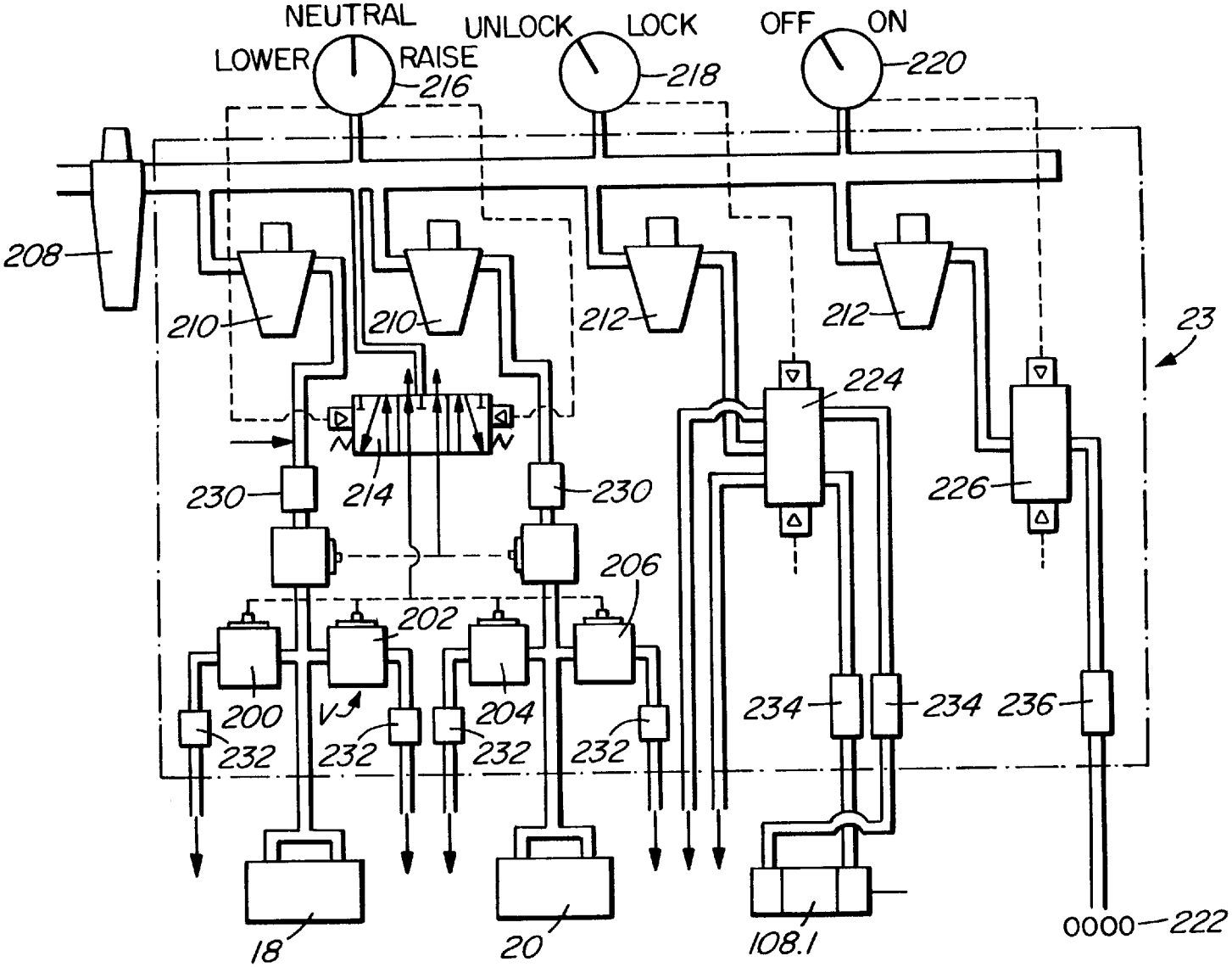
FIG. 15 is a schematic diagram of the control panel of FIG. 7.

Details of the control panel 23 are shown in FIG. 15. Two of the buoyancy chambers 18 and 20 are shown in this view. The exhaust valves v in this example comprise four pilot operated exhaust valves 200, 202, 204 and 206. When a pilot signal is sent, these valves open to allow a full flow from the buoyancy chambers. There is a filtration assembly 208 which, in this embodiment, consists of two filters. The first filter removes liquid water and oil as well as solid particles to 1 micron. A second filter is a high efficiency oil removal filter which coalesces fine water and oil aerosols. It also removes solid particles to 0.01 micron.

Air line regulators 210, complete with gauges, set pressures to 40 psi. Air line regulators 212, complete with gauges, set pressures to 60 and 20 psi. These values, like other details of the controls, may be varied in alternative embodiments.

Valve 214 is a NPT ported, three position, double air pilot, four way signal control valve in this example. It is used to control the sequence of the exhaust valves. Selector switch 216 is a three position, maintained selector switch which provide signals to raise or lower the platform. When there is no pilot signal from switch 216, valve 214 is in its neutral state and has all signals exhausted, rendering all exhaust valves closed. Switch 218 is a two position, maintained selector switch which provides signals to lock or unlock air cylinder 108.1. Switch 220 is a similar switch which turns on bubbles when desired.

There is a ported, single air pilot control valve 224 used to operate the double acting air cylinder 108.1 used in the embodiment of FIGS. 4, 5, 6 and 8–14. This takes one signal to shift the valve and returns to its neutral state once the signal from the selector switch is removed. A similar valve 226 is used to provide air for the bubble effect 222.

There are two flow control valves 230 which are used to control the rate of flow when air is entering the buoyancy chambers. There are four flow control valves 232 which are installed in case the flow from one of the buoyancy chambers needs to be slowed down. Flow control valves 234 control the rate of flow to the air cylinder 108.1. A similar valve 236 controls the rate of flow to the bubble defect.

Referring to FIG. 1, platform 16 is slightly smaller the cross-section than pool 17 such that it occupies substantially the entire area of the pool in plan, with a relatively small clearance, approximately 1 inch in this example, to allow up and down movement of the platform and to accommodate a plurality of vertical racks 24 mounted on the pool to guide the up-and-down movement of the platform in conjunction with other equipment described below. The platform has a plurality of pinions, each engaging one of the racks. The platform of this example is constructed entirely of pultruded fiber reinforced plastic (PFRP), apart from the fasteners which are of 316 stainless-steel in this example, and other non-structural components. The platform is perforated with slots (5/16"×1¼" in this example) to facilitate the lowering and raising of the platform. Surface 26 of the platform in this example is finished with non-slip fine grit. It should be understood, however, that other materials and configurations of platforms could be substituted.

An alternative apparatus 11.1 is shown in FIGS. 4, 5, 6 and 8–14. Like parts have like the platform has a top 30.1 and a bottom 32.1. Decking 36.1 extends completely across the top 30.1 of the platform. The decking is supported by a plurality of girders and beams. In this example, there are two 12 inch girders 38.1 and 40.1 extending between opposite sides 42.1 and 44.1 of the platform. Seven spaced-apart eight inch beams 45.1 extend between the sides and between the girders 38.1 and 40.1. Two 12 inch girders 48.1 and 50.1 extend between opposite ends 52.1 and 54.1 of the platform adjacent the sides 42.1 and 44.1. Five 8 inch beams 58.1 extend between the ends and the girders 48.1 and 50.1. These beams and girders supply structural rigidity to the decking.

There are two buoyancy chambers 18.1 and 19.1 in this platform. In this embodiment each chamber is simply a PFRP box with an open bottom. Each is approximately 8'×8'×15½" in this embodiment although the size and number of chambers may vary depending upon the size of the platform.

Figure 10:
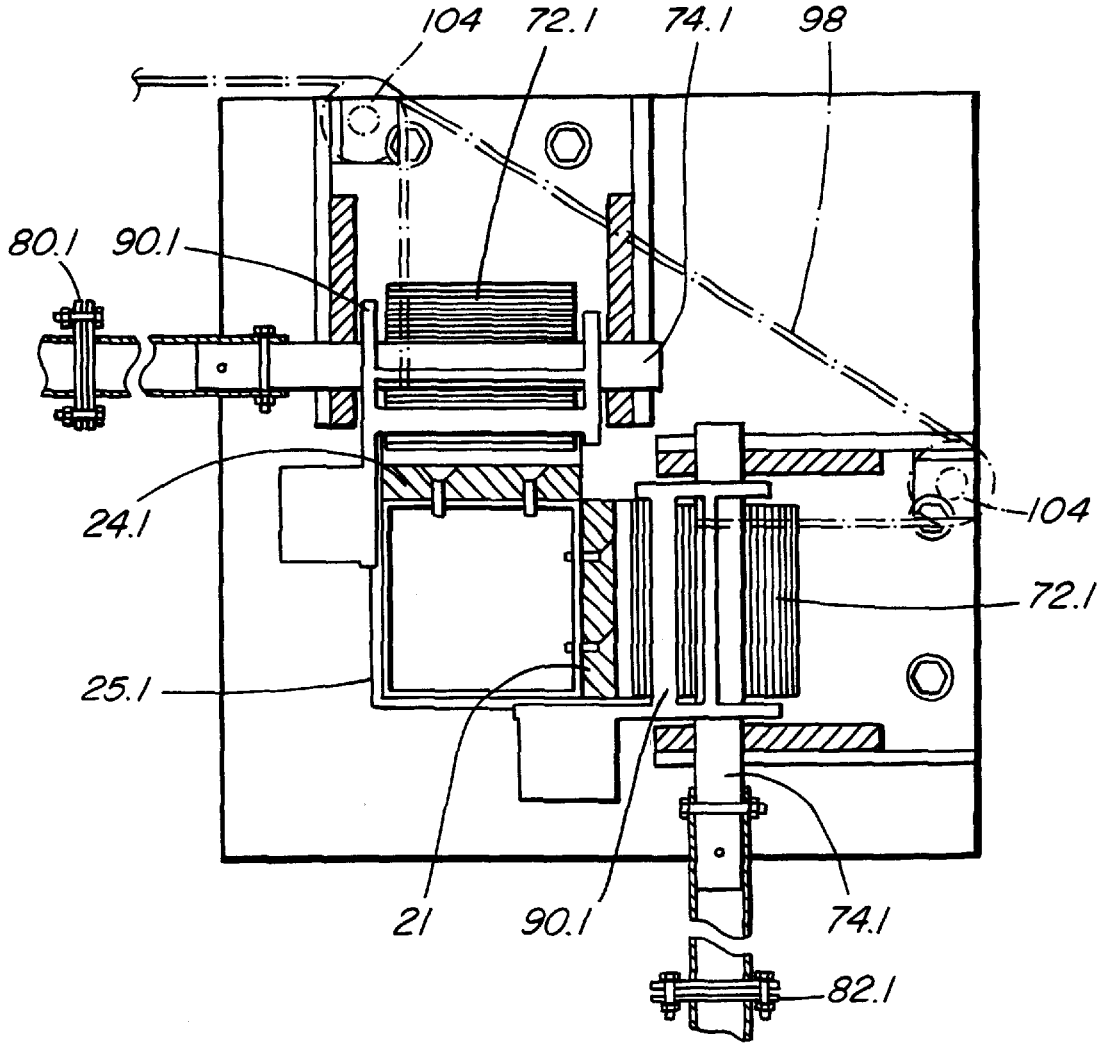
FIG. 10 is a fragmentary, top plan view, partly in section, showing two of the pinions and one of the racks at a corner location.
Figure 11:
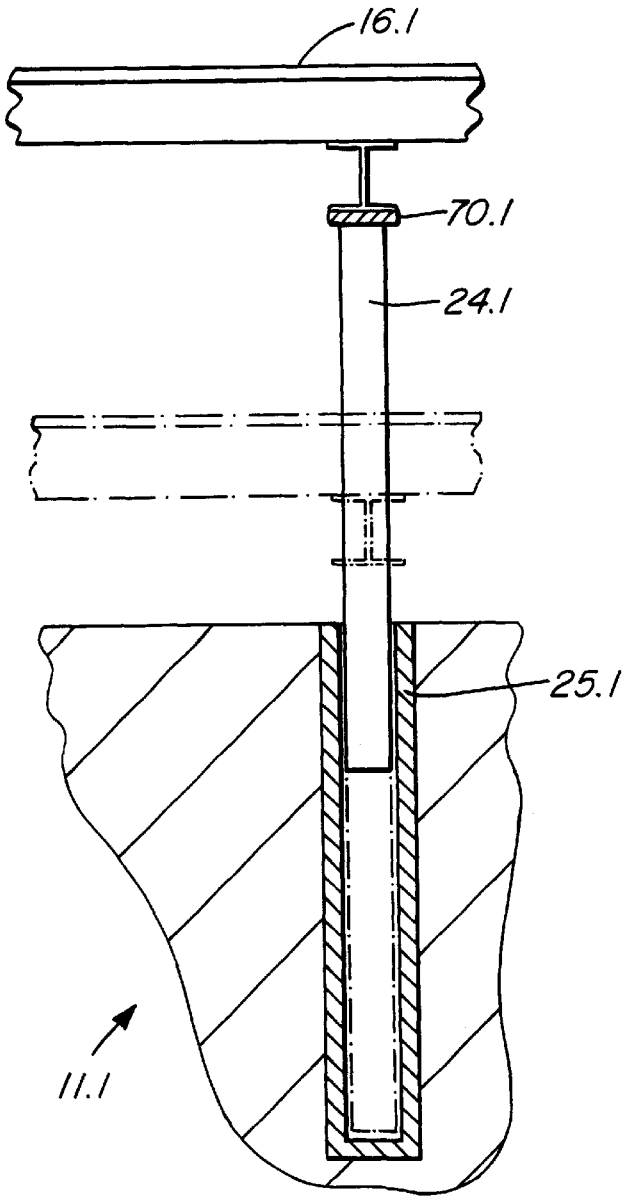
FIG. 11 is enlarged, fragmentary side elevation showing one of the racks and a fragment of the pool bottom.
Figure 12:
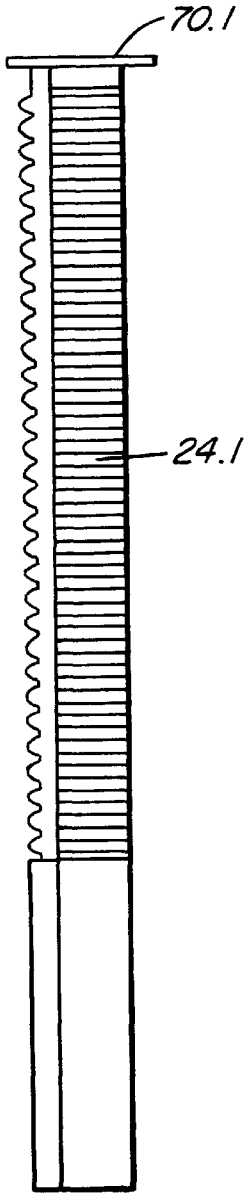
FIG. 12 is a side view of one of the racks.

There is a guide mechanism for guiding the platform as it is raised or lowered. This mechanism includes the plurality of vertically oriented racks 24.1, eight of them in this example, three along each side and two along each end of the platform. One of the racks is better shown in FIG. 12. In this particular example the racks are of nylon mounted on stainless-steel tubes 25.1 as shown in FIG. 10. They are connected to pads 70.1 on the bottom ofthe platform. Thus, in this example, the racks are mounted on the platform instead of the pool as in the previous embodiment. Each of the racks is slidingly received within a socket 25.1 in the bottom ofthe pool which are slightly wider and deeper than the racks. The racks descend into the sockets when the platform is lowered.

Figure 8:
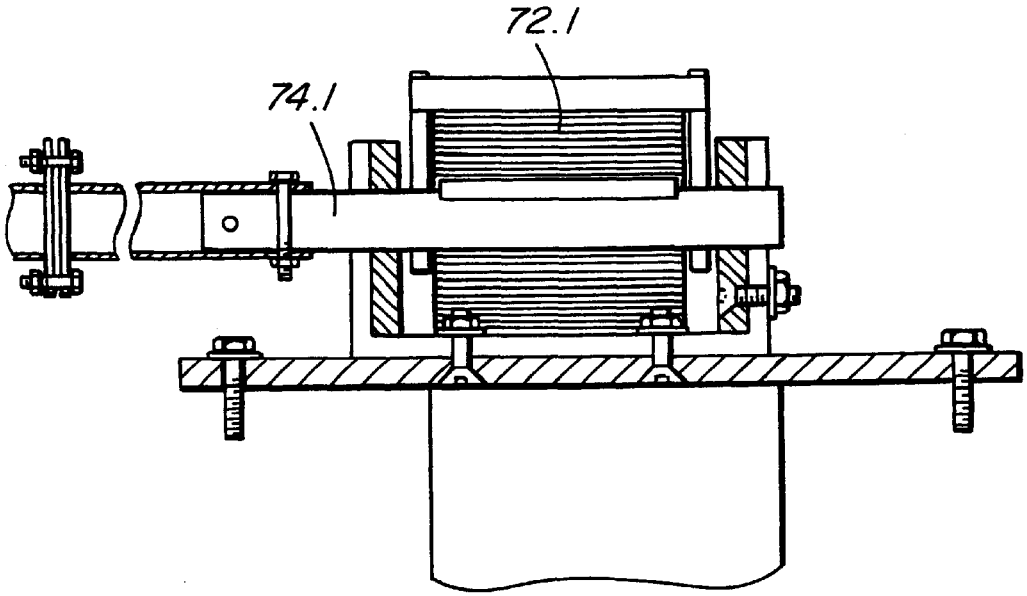
FIG. 8 is a fragmentary sectional view showing one of the pinions, and associated components, used for raising and lowering the platform for the embodiment of FIG. 4.
Figure 9:
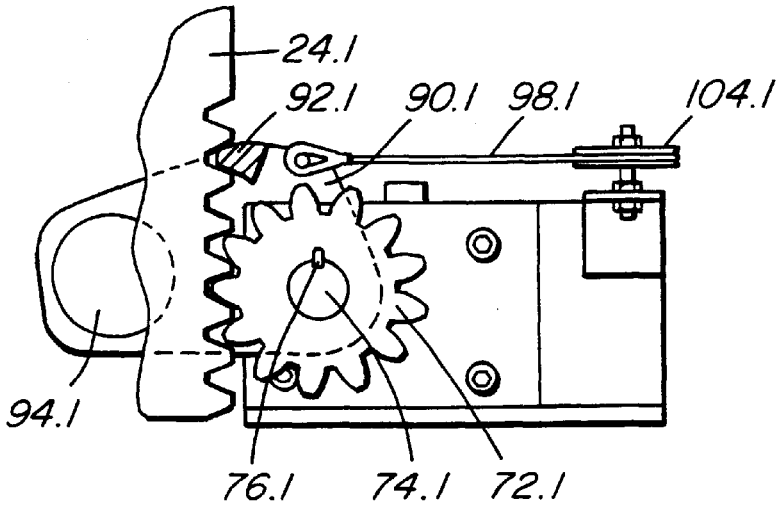
FIG. 9 is a side view of one of the pawls thereof, with associated cable and pulley and a pinion shown in ghost.

The apparatus is provided with a plurality of pinions 72.1, one for each of the racks 24.1 as shown in FIGS. 8–10. The pinions, and the associated mechanisms, are mounted on the pool walls adjacent the platform. This is opposed to the previous embodiment where the pinions were mounted on the platform. Each pinion is rotatably supported by a shaft 74.1 and is keyed to the shaft by a key 76.1. The shafts 74.1 are interconnected by couplings 80.1 and 82.1 such that the shafts and pinions rotate synchronously. This keeps the floor level as it is raised and lowered by means of the buoyancy chambers.

There is a pawl 90.1 rotatably mounted on shaft 74.1 adjacent each of the pinions. The pawl has a finger 92.1 which is concavely curved on bottom and convexly curved on top. Thus each finger normally engages one of the racks 24.1 under the weight of platform 16 and prevents the platform from moving downwardly. When the platform moves upwardly, the finger clicks along the rack, allowing upward movement of the platform. Counterweight 94. lbiases the finger 92.1 into engagement with the rack. A series of cables 98.1, connected together by tumbuckles 102.1, shown in FIG. 14, and guided by pulleys 104.1, connect the pawls to a bell crank 106.1 and air cylinders 108.1 as shown in FIGS. 9, 10, 13 and 14. Thus, by activating air cylinders 108.1, the cables are pulled to disengage fingers 92 from the racks in order to lower the platform.

Figure 5:
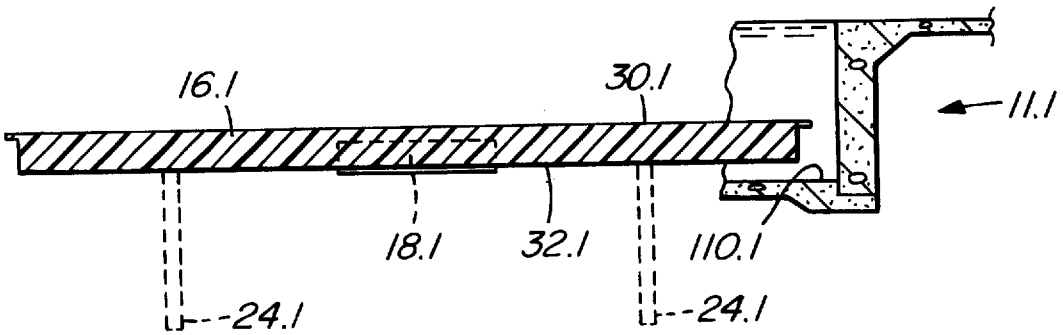
FIG. 5 is a view similar to FIG. 2 of the alternative embodiment.
Figure 6:
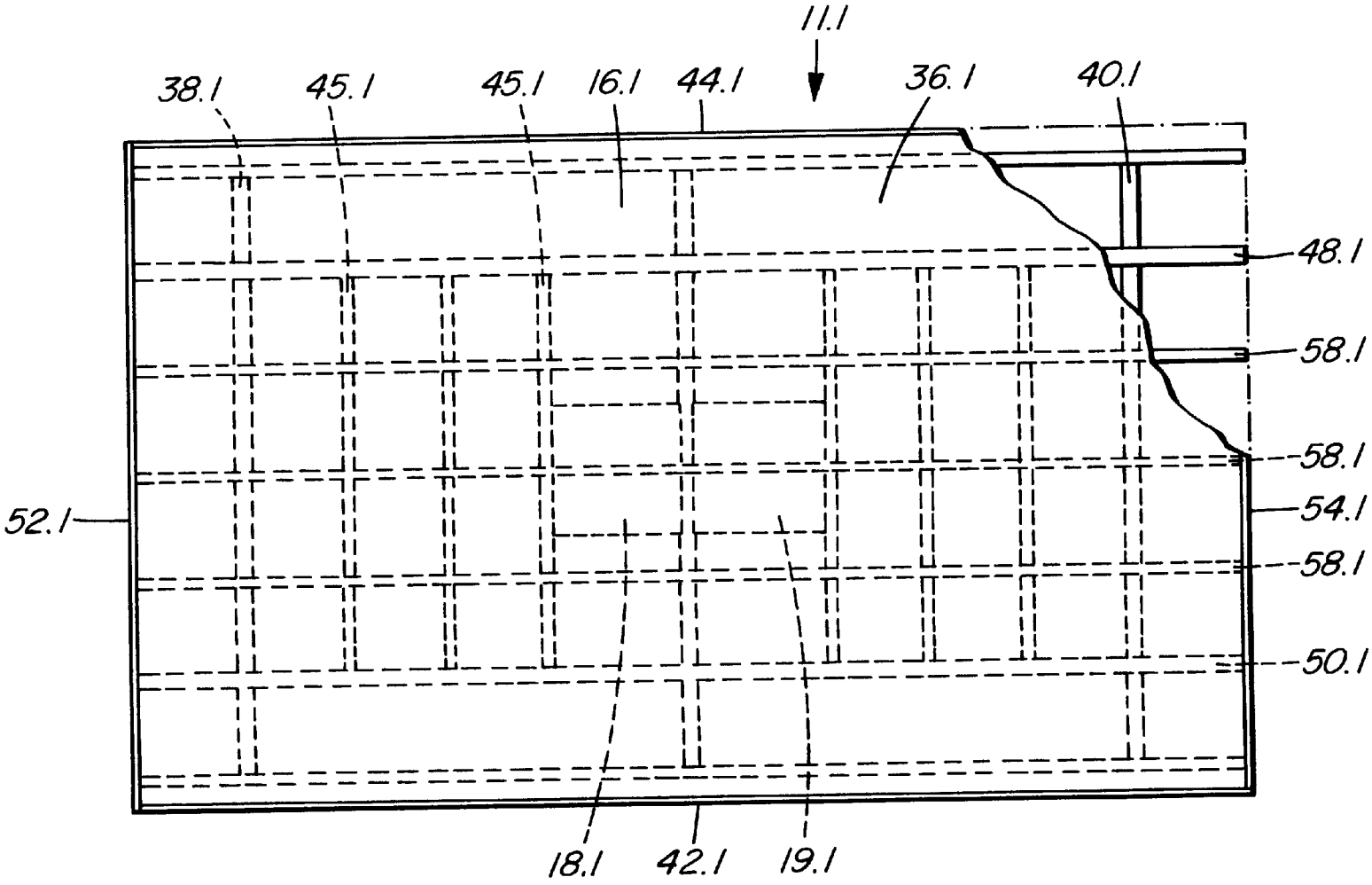
FIG. 6 is a top plan view of the embodiment of FIGS. 4 and 5 with structural members shown in broken lines and with the decking shown partly broken away.
Figure 7:
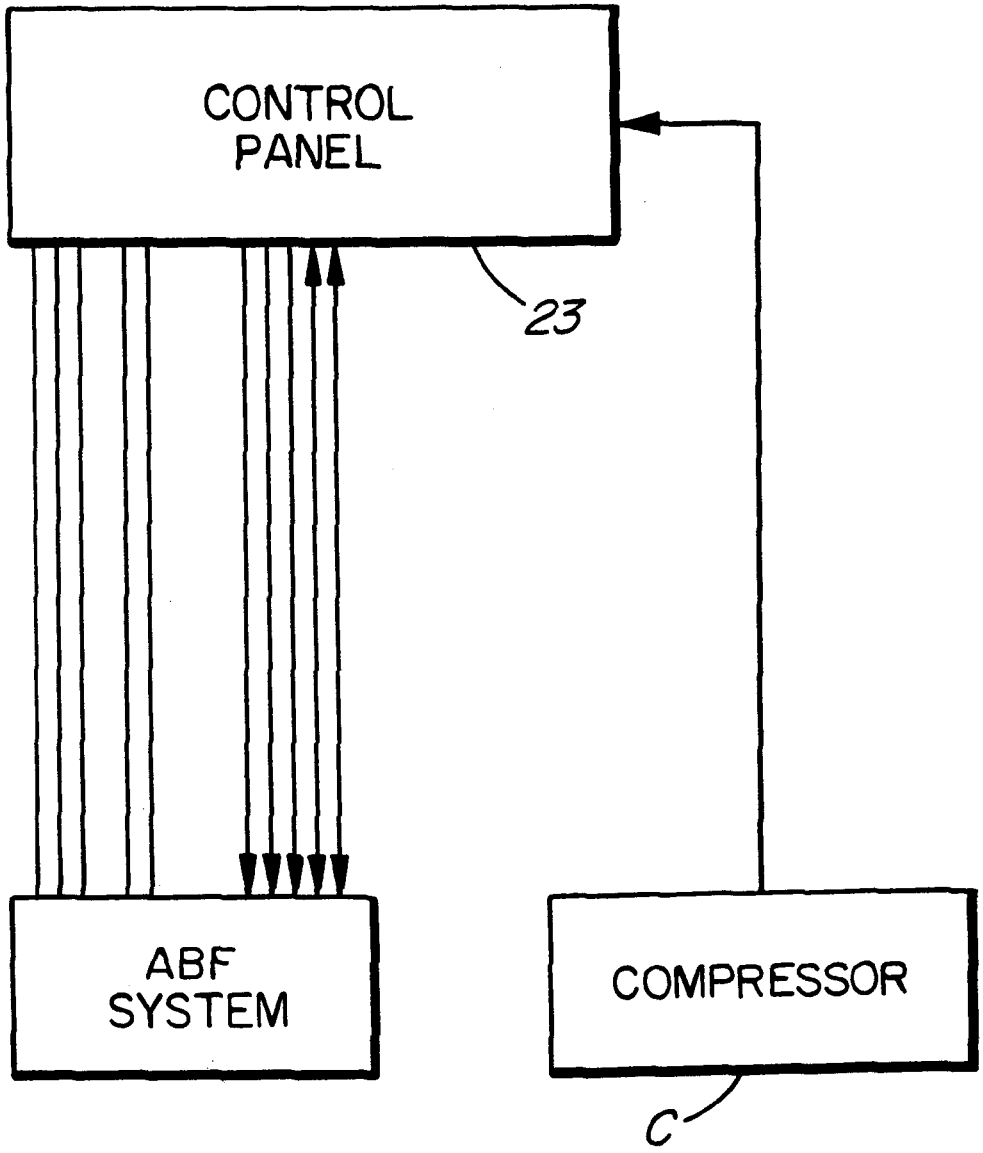
FIG. 7 is a flow chart showing the control system thereof.

In operation, with reference to FIG. 5, platform 16.1 is shown at its maximum depth resting on the bottom 110.1 of the pool. The buoyancy chambers 18.1 and 19.1 are filled with water. When it is desired to have a shallower pool, air from compressor C, shown in FIG. 7, is pumped into the buoyancy chambers 18.1 and 19.1 to fill the buoyancy chambers with air. The buoyant platform rises with the fingers 92 clicking along the racks 24.1. The pinions 72.1 turn synchronously, since they are interconnected by shafts 74.1, to ensure that the platform continues level as it rises to the position shown in FIG. 2. In this position the fingers 92 prevent the platform from moving downwardly.

Figure 13:
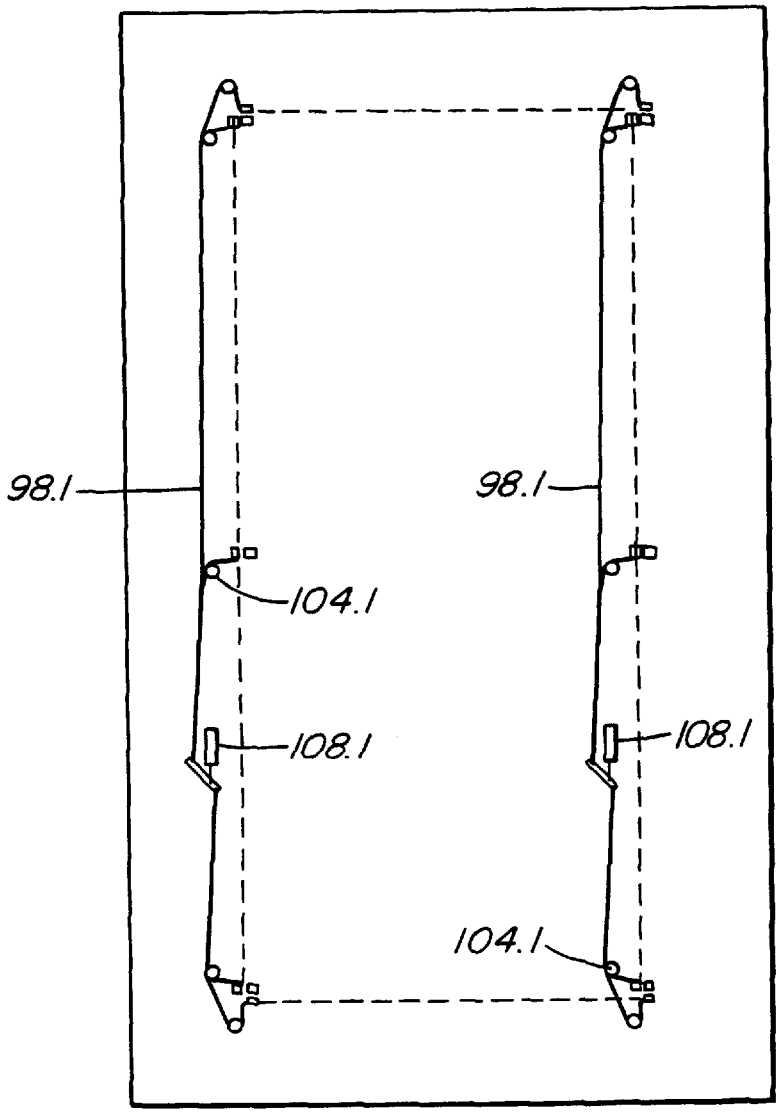
FIG. 13 is a top plan view showing the cables, pulleys and actuators for moving the pawls.
Figure 14:
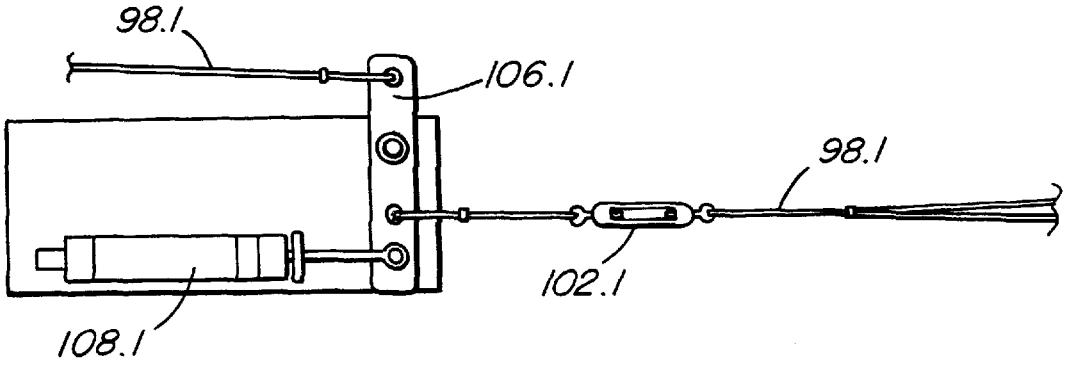
FIG. 14 is an enlarged, side elevation view of one of the actuators for the pawls and associated cables in fragment.

When it is desired to have a deeper pool, the valve in control panel 23 is opened, venting air from the buoyancy chambers to atmosphere. The air cylinders 108.1, shown in FIG. 13, are actuated to pull back the fingers 92.1 from engagement with the racks. The platform 16 sinks until it reaches the desired level, for example of the bottom of the pool as shown in FIG. 3.

The embodiment of FIGS. 1–3 operates in a similar manner except that the platform moves with respect to the fixed racks 24 and the pinions, similar to pinions 72.1 of the alternative embodiment, are rotatably mounted on the platform.

It will be understood by someone skilled in the art that many of the features described above are by way of example only and can be varied or deleted without departing from the scope of the invention as set out in the following claims.

What is claimed is:

1. A raisable floor apparatus for a pool, comprising:

a platform;

a chamber in the platform with a top and a bottom, the chamber being closed on the top and open to the pool near the bottom;

an air supply means;

a conduit connecting the air supply means to the chamber;

means for venting the chamber to atmosphere, whereby the platform is raised by filling the chamber with air from the air supply means when the pool is at least partially filled with water and the platform is lowered by venting air from the chamber to atmosphere through the means for venting; and a guide mechanism for guiding the platform as the platform is raised and lowered, the guide mechanism including vertically extending racks and pinions, each said pinion engaging one of the racks.

2. An apparatus as claimed in claim 1, wherein the platform has a plurality of additional chambers, each similar to said chamber, each said chamber being connected to the air supply means and each having means for venting said each chamber to atmosphere.

3. An apparatus as claimed in claim 2, wherein the platform has three additional chambers.

4. An apparatus as claimed in claim 1, wherein the platform has an outer periphery and a center, the chambers being adjacent the center.

5. An apparatus as claimed in claim 4, wherein the chambers have open bottoms.

6. An apparatus as claimed in claim 1, wherein the platform has a planar top, a bottom and a plurality of spaced-apart structural beams therebetween.

7. An apparatus as claimed in claim 6, wherein the platform is of reinforced polymer.

8. An apparatus as claimed in claim 1, including means for synchronously rotating the pinions as the platform is raised and lowered.

9. An apparatus as claimed in claim 8, wherein the means for synchronously rotating includes a shaft operatively interconnecting the pinions.

10. An apparatus as claimed in claiming 9, including pawls releasibly engaging the racks to selectively maintain the platform at a given vertical position.

11. A raisable floor apparatus for a pool, comprising:

a platform;

means for raising and lowering the platform to make at least a portion of the pool shallower or deeper;

a guide mechanism for guiding the platform as the platform is raised or lowered, the guide mechanism including vertically extending racks and pinions, each said pinion engaging one of the racks;

means for synchronously rotating the pinions as the platform is raised and lowered, the means for synchronously rotating including a shaft operatively interconnecting the pinions;

pawls releasibly engaging the racks to selectively maintain the platform at a given vertical position; and a mechanism operatively interconnecting the pawls, whereby the pawls can be simultaneously released from the racks, allowing the platform to move.

12. An apparatus as claimed in claim 11, wherein the racks are mounted on the platform and extend downwardly therefrom, the pinions being rotatably mounted on the pool adjacent to the platform.

13. An apparatus as claimed in claim 12, wherein the pool has sockets on the bottom thereof for slidingly receiving the racks.

14. A raisable floor apparatus for a pool, comprising:

a platform;

means for raising and lowering the platform to make at least a portion of the pool shallower or deeper; and a guide mechanism for guiding the platform as the platform is raised or lowered, the guide mechanism including vertically extending racks and pinions, each said pinion engaging one of the racks, the racks being mounted on the pool adjacent to the platform and the pinions being rotatably mounted on the platform.

* * * * *